US009630039B2

(12) United States Patent
Koiwa

(10) Patent No.: US 9,630,039 B2
(45) Date of Patent: Apr. 25, 2017

(54) SPRINKLER HEAD

(75) Inventor: Yasuaki Koiwa, Tokyo (JP)

(73) Assignee: SENJU SPRINKLER CO., LTD., Tokyo (JP)

( * ) Notice: Subject to any disclaimer, the term of this patent is extended or adjusted under 35 U.S.C. 154(b) by 628 days.

(21) Appl. No.: 13/638,956

(22) PCT Filed: Apr. 1, 2011

(86) PCT No.: PCT/JP2011/058382

§ 371 (c)(1),
(2), (4) Date: Oct. 2, 2012

(87) PCT Pub. No.: WO2011/125921

PCT Pub. Date: Oct. 13, 2011

(65) Prior Publication Data

US 2013/0020406 A1 Jan. 24, 2013

(30) Foreign Application Priority Data

Apr. 6, 2010 (JP) ..... 2010-087432

(51) Int. Cl.
*A62C 37/08* (2006.01)
*A62C 35/68* (2006.01)
(Continued)

(52) U.S. Cl.
CPC ..... *A62C 35/68* (2013.01); *A62C 37/14* (2013.01); *B25B 13/02* (2013.01); *B25B 13/06* (2013.01); *B25B 13/48* (2013.01); *A62C 37/09* (2013.01)

(58) Field of Classification Search
CPC ..... A62C 35/68; A62C 37/09; B25B 13/02; B25B 13/06; B25B 13/48; B25B 13/50
(Continued)

(56) References Cited

U.S. PATENT DOCUMENTS 4,014,388 A 3/1977 Anderson
4,066,129 A 1/1978 Anderson
(Continued)

FOREIGN PATENT DOCUMENTS

JP 4-15234 Y2 4/1992
JP 7-39858 U 7/1995
(Continued)

OTHER PUBLICATIONS

International Search Report for PCT Patent App. No. PCT/JP2011/058382 (May 10, 2011).
(Continued)

*Primary Examiner* — Alexander Valvis
(74) *Attorney, Agent, or Firm* — Cermak Nakajima & McGowan LLP; Tomoko Nakajima

(57) ABSTRACT

There is provided a sprinkler head having a structure in which steps such as removing and reattaching a protecting cap are eliminated at the time of construction of the sprinkler head, where a cylindrical member is installed on an outer portion of a sprinkler head body and the protecting cap is installed between the sprinkler head body and the cylindrical member. A cylindrical member and a sprinkler head body are installed by being engaged so as to be rotatable together, a protecting cap configured to protect the sprinkler head body from an external force is locked to the cylindrical member. The protecting cap is provided with a space in which a tightening tool for connecting a sprinkler head to a water supply pipe is capable of locking to a tightening tool engaging portion.

18 Claims, 12 Drawing Sheets

(51) Int. Cl.

| | |
|---|---|
| ***B25B 13/48*** | (2006.01) |
| ***B25B 13/06*** | (2006.01) |
| ***B25B 13/02*** | (2006.01) |
| ***A62C 37/14*** | (2006.01) |
| *A62C 37/09* | (2006.01) |

(58) Field of Classification Search
USPC ..... 169/37–41; 239/600; 81/176.1, 176.15, 81/176.2, 124.2, 471
See application file for complete search history.

(56) References Cited

U.S. PATENT DOCUMENTS

| | | | | |
|---|---|---|---|---|
| 4,706,759 | A | 11/1987 | Grasseschi | |
| 4,880,063 | A * | 11/1989 | Leininger | A62C 37/12 169/37 |
| 5,048,378 | A * | 9/1991 | Nikolas | B25B 13/06 81/124.2 |
| 5,372,203 | A | 12/1994 | Galaszewski | |
| 5,687,914 | A | 11/1997 | Bosio et al. | |
| 7,055,614 | B1 | 6/2006 | Ide | |
| 7,185,567 | B2 * | 3/2007 | Ide | B25B 13/06 81/124.2 |
| 7,891,716 | B2 * | 2/2011 | Orr | B25B 27/00 294/209 |
| 2004/0226416 | A1 * | 11/2004 | Lane | B25B 27/18 81/176.15 |
| 2005/0247169 | A1 * | 11/2005 | Faries | B25B 13/485 81/176.15 |
| 2006/0249603 | A1 * | 11/2006 | Fletcher | 239/600 |

FOREIGN PATENT DOCUMENTS

| | | | |
|---|---|---|---|
| JP | 09-108379 | A | 4/1997 |
| JP | 2001-157722 | A | 6/2001 |
| JP | 2008-086394 | A | 4/2008 |
| JP | 2009-291359 | A | 12/2009 |
| WO | WO2006/133057 | A2 | 12/2006 |
| WO | WO2010/038253 | A1 | 4/2010 |
| WO | WO2011/125921 | A1 | 10/2011 |

OTHER PUBLICATIONS

Office Action for Japanese Patent App. No. 2012-509624 (Apr. 3, 2013).
Office Action for Japanese Patent App. No. 2012-509624 (Jan. 15, 2013).

* cited by examiner

SPRINKLER HEAD

TECHNICAL FIELD

The present invention relates to a fire extinguishing sprinkler head.

BACKGROUND ART

A sprinkler head is installed on a ceiling surface or a wall surface in a building, and includes a nozzle which can be connected to piping continuing to a water supply at one end thereof, and a thermosensitive operating portion at the other end thereof. At a non-emergency time, the thermosensitive operating portion supports a valve body configured to close the nozzle.

As an example of the sprinkler head, there is a concealed sprinkler head configured to be installed in a state of being embedded in a ceiling surface or a wall surface, in which the sprinkler head is hidden and covered by a cover plate. The concealed sprinkler head is used as a sprinkler head that is superior in terms of design and, for example, there is the one described in Patent Literature 1. The concealed sprinkler head in Patent Literature 1 is provided with a cylindrical member on the outer portion of a so-called frame yoke type sprinkler head, which includes a horseshoe-shaped frame extending from a terminal end of the nozzle and a deflector installed on an extension portion of the nozzle, and an engaging portion for the cover plate provided on a lower portion of the cylindrical member.

A sprinkler head illustrated in FIG. 12 has a similar structure to the concealed sprinkler head of Patent Literature 1, in which a cylindrical member A is provided outside a frame yoke type sprinkler head SH (hereinafter referred to as "sprinkler head SH"), and a cylindrical retainer B having a cover plate P joined thereto by a low melting point alloy is connected to the lower portion of the cylindrical member A.

As a structure of a connecting portion between the cylindrical member A and the retainer B, a helical groove A1 formed in the lower portion of the cylindrical member A and a projection B1 formed so as to project from an outer peripheral surface of the retainer B are configured to be capable of being engaged with each other by being screwed together.

The sprinkler head SH, the cylindrical member A, and the retainer B are arranged on the back side of the ceiling, and only the cover plate P is arranged in the vicinity of the ceiling surface. Since the cover plate P is connected to the retainer B by the low melting point alloy, the cover plate P drops due to heat generated in case of fire. Dropping of the cover plate P exposes the sprinkler head SH.

When the sprinkler head SH is exposed, subsequently, a thermosensitive operating portion G of the sprinkler head SH is operated and destroyed to release the valve body in the interior of the sprinkler head SH, so that water is sprinkled from the sprinkler head SH to extinguish the fire.

Patent Literature 1: U.S. Pat. No. 4,014,388

DISCLOSURE OF INVENTION

Problems to be Solved by the Invention

The above described concealed sprinkler head includes a cylindrical protecting cap C fitted to an inner peripheral surface of the cylindrical member in order to prevent deformation or breakage of one cylinder member due to an external impact at the time of transport or construction as illustrated in FIG. 11. Due to the protecting cap C fitted to the peripheral surface of the cylindrical member, the retainer B cannot be mounted on the cylindrical member A unless the protecting cap C is removed.

The sprinkler head SH includes an engaging portion K with which a fastening tool is engaged between a frame F and a piping connection screw portion T and, when mounting the sprinkler head SH on the piping, the protecting cap C is removed from the cylindrical member A, the engaging portion K of the sprinkler head SH in the cylindrical member A is gripped by the fastening tool, and a screw portion T of the sprinkler head SH is screwed to a screw portion on the piping side.

When the connection with the piping is complete, the protecting cap C is mounted on the cylindrical member A again in order to protect the sprinkler head SH from an external force at the time of constructing a ceiling board. When the construction of the ceiling board is finished, the protecting cap C is removed and the retainer B having the cover plate P installed thereon is mounted on the cylindrical member A. As a result, the sprinkler head SH in the cylindrical member A is constructed in a state of being shielded by the cover plate P.

Therefore, in the concealed head described above, removal of the protecting cap C is performed twice, and for an operator, mounting and removal of the protecting cap C are cumbersome. The probability of occurrence of failure such as forgetting to put the protecting cap C back on is quite high.

Accordingly in the present invention, in view of such a problem as described above, it is an object of the present invention to provide a sprinkler head having a structure in which steps such as removing and reattaching a protecting cap are eliminated at the time of construction of the sprinkler head.

Means for Solving the Problems

In order to achieve the above-described object, the present invention provides a sprinkler head as described below.

The present invention is characterized in that a cylindrical member is installed on an outer portion of a sprinkler head body, the cylindrical member and the sprinkler head body are installed by being engaged so as to be rotatable together, a protecting cap configured to protect the sprinkler head body from an external force is locked to the cylindrical member, and the protecting cap is provided with a space in which the tightening tool for connecting a sprinkler head to water supply pipe is capable of locking to a tightening tool engaging portion provided on the cylindrical member.

In the configuration described above, the sprinkler head can be connected to the water supply pipe by engaging the tightening tool with the tightening tool engaging portion of the cylindrical member and operating the tightening tool in a state in which the protecting cap is mounted. Therefore, an operation to set the tightening tool to the sprinkler head after the protecting cap is removed when connecting the sprinkler head to the water supply pipe and an operation to connect the sprinkler head to the water supply pipe and then mounting the protecting cap again on the sprinkler head are eliminated, so that the burden of the operator is alleviated.

The sprinkler head according to the present invention may be configured in such a manner that the tightening tool engaging portion of the cylindrical member is a plurality of openings provided on a flat surface formed at one end of the cylindrical member installed so as to be engaged with the sprinkler head body.

In the configuration described above in which the plurality of openings are configured as the tightening tool engaging portions, the tightening tool engaging portions appear on the outer surface of the sprinkler head, so that the operator can determine that the tightening tool is engaged with the openings instinctively. Specifically, if the shape of the openings and the shape of the portion of the tightening tool to be engaged with the openings are substantially the same, the operator is capable of determining that the tightening tool is to be engaged with the openings instinctively.

The sprinkler head of the present invention man be configured in such as manner that the openings are formed continuously to a side surface of the cylindrical member.

By forming the openings continuously to the side surface of the cylindrical member, the tightening tool can be engaged from the outside of the cylindrical member. More specifically, engaging the tightening tool with the openings from the side surface of the cylindrical member, or the ring-shaped tightening tool which can fit from the flat surface side to the side surface side of the opening may be used.

According to the sprinkler head of the present invention, the cylindrical member and the sprinkler head body are installed so as to be capable of rotating together by being engaged with a support base formed with a notch having a shape which conform to the opening interposed between.

By the intermediary of the support base, when the sprinkler head is mounted onto and demounted from the water supply pipe by a tightening tool so that tightening tool engaging portion is prevented from being deformed and broken even when an excessive load is applied to tightening tool engaging portion of the cylindrical member. In addition, by reinforcing the tightening tool engaging portion with the support base, the cylindrical member may be formed to be thin.

In addition, in order to engage and install the support base with the sprinkler head body and the cylinder member so as to be capable of rotating together, it is realizable by installing the same structure as the engaging structure between the sprinkler head body and the cylindrical member also on the support base. More specifically, it is realized by installing a polygonal shaped fitting portion on the sprinkler head body side, forming holes having substantially same shape on the cylindrical member and the support base are formed with, and inserting the cylindrical member and the holes of the support base onto the fitting portions.

According to the sprinkler head of the present invention, the protecting cap is engageable with the tightening tool engaging portion of the cylindrical member.

According to the configuration as described above, by engaging the protecting cap with the tightening tool engaging portion of the cylindrical member, the tightening tool can be engaged with the tightening tool engaging portion via the protecting cap. Accordingly, since the force of the tightening tool is applied indirectly to the edge portion of the tightening tool engaging portion, the force is prevented from intensively applied to one point, and hence deformation and breakage of the tightening tool engaging portion is prevented.

Also, by providing the protecting cap with a guide portion configured to guide the tightening tool to the tightening tool engaging portion of the cylindrical member, the tightening tool can be set correctly to the tightening tool engaging portion. The specific structure of the guide portion is realizable by forming convexo-concave portion which guides the tightening tool on the outer surface of the protecting cap or by forming a hole or a cylinder which allow insertion of the tightening tool.

In addition, the tightening tool can be engaged with the edge of the opening of the cylindrical member via the protecting cap and, more specifically, can be realized by engaging an end of the above-described guide portion with the edge of the opening.

According to the sprinkler head of the present invention, the protecting cap is engageable with a support base protruding from the opening of the cylindrical member.

By engaging the protecting cap with the support base protruded from the opening of the cylindrical member, a rotational force applied by the tightening tool can be applied only on the side surface of the support base. By configuring in such a manner that the rotational force applied by the tightening tool is received only by the support base and making the wall of the cylindrical member thin, the helical groove of the side surface of the cylindrical member can be formed by rolling.

According to the sprinkler head of the present invention, the protecting cap is configured to be engaged with a reinforcing member formed so as to extend engageable with a support base protruding from the opening of the cylindrical member.

By the reinforcing portion formed so as to extend from the opening, the opening is made resistible to the rotational force applied from the tightening tool and hence can be prevented from deformation or breakage.

According to the sprinkler head of the present invention, the protecting cap may be formed with a handle and the handle is provided with a fragile portion which is broken when the handle is rotated at a predetermined or more torque.

By the breakage of the fragile portion by being rotated at a predetermined or more torque, the sprinkler head cannot be tightened any longer into the water supply pipe, so that the breakage of the sprinkler head and the water supply pipe by excessive tightening of the screw portion is prevented.

According to the sprinkler head of the present invention, the support base and the cylindrical member can be installed by being engaged so as to be rotatable together.

In this configuration, the support base and the cylindrical member are integrated by installing in engagement, and improving the strength in the vicinity of the opening against the rotational force applied by the tightening tool, so that the breakage can be prevented.

Advantageous Effects of the Invention

According to the present invention, since the connecting work of the sprinkler head with the water supply pipe is possible in the state in which the protecting cap is mounted, the burden of the operator can be alleviated. Furthermore, even when setting the tightening tool to the sprinkler head, the setting position can be determined instinctively. Also, when mounting and demounting the sprinkler head with respect to the water supply pipe by operating the tightening tool with respect to the tightening tool engaging portion with which the tightening tool is engaged via the protecting cap, the breakage and the deformation of the tightening tool engaging portion may be prevented.

BEST MODES FOR CARRYING OUT THE INVENTION

Figure 1:
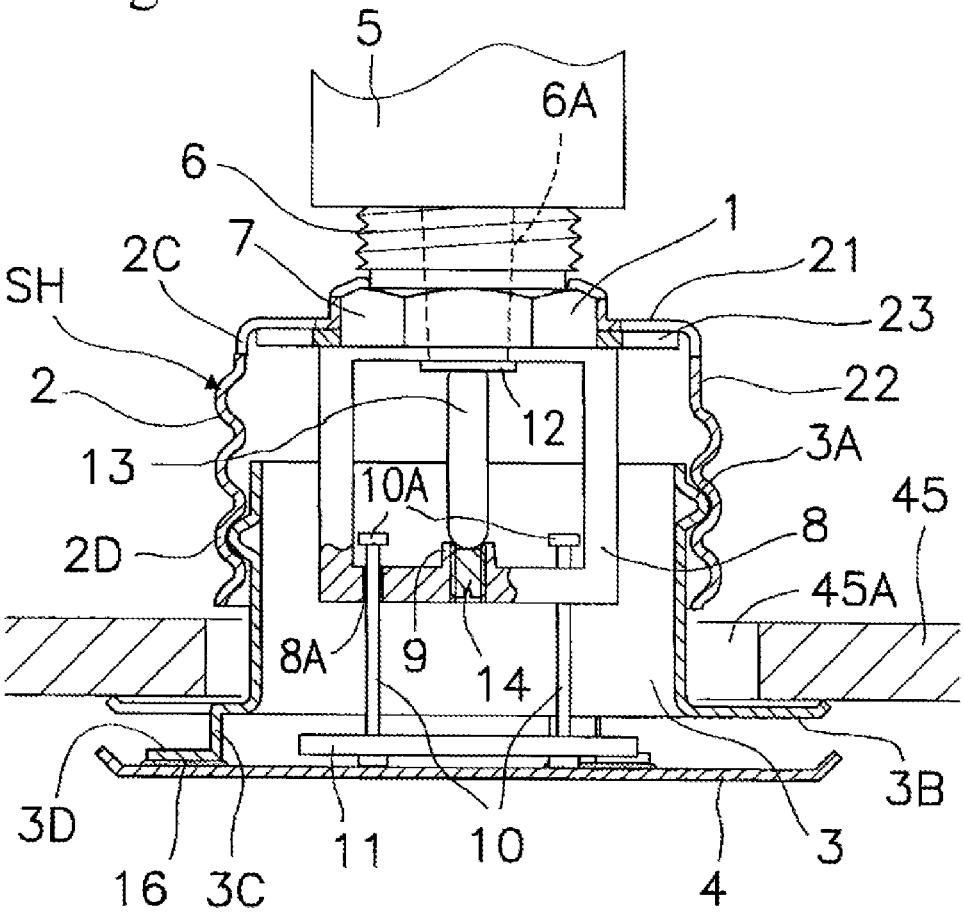
FIG. 1 is a cross-sectional view of a sprinkler head according to a first embodiment.
Figure 2:
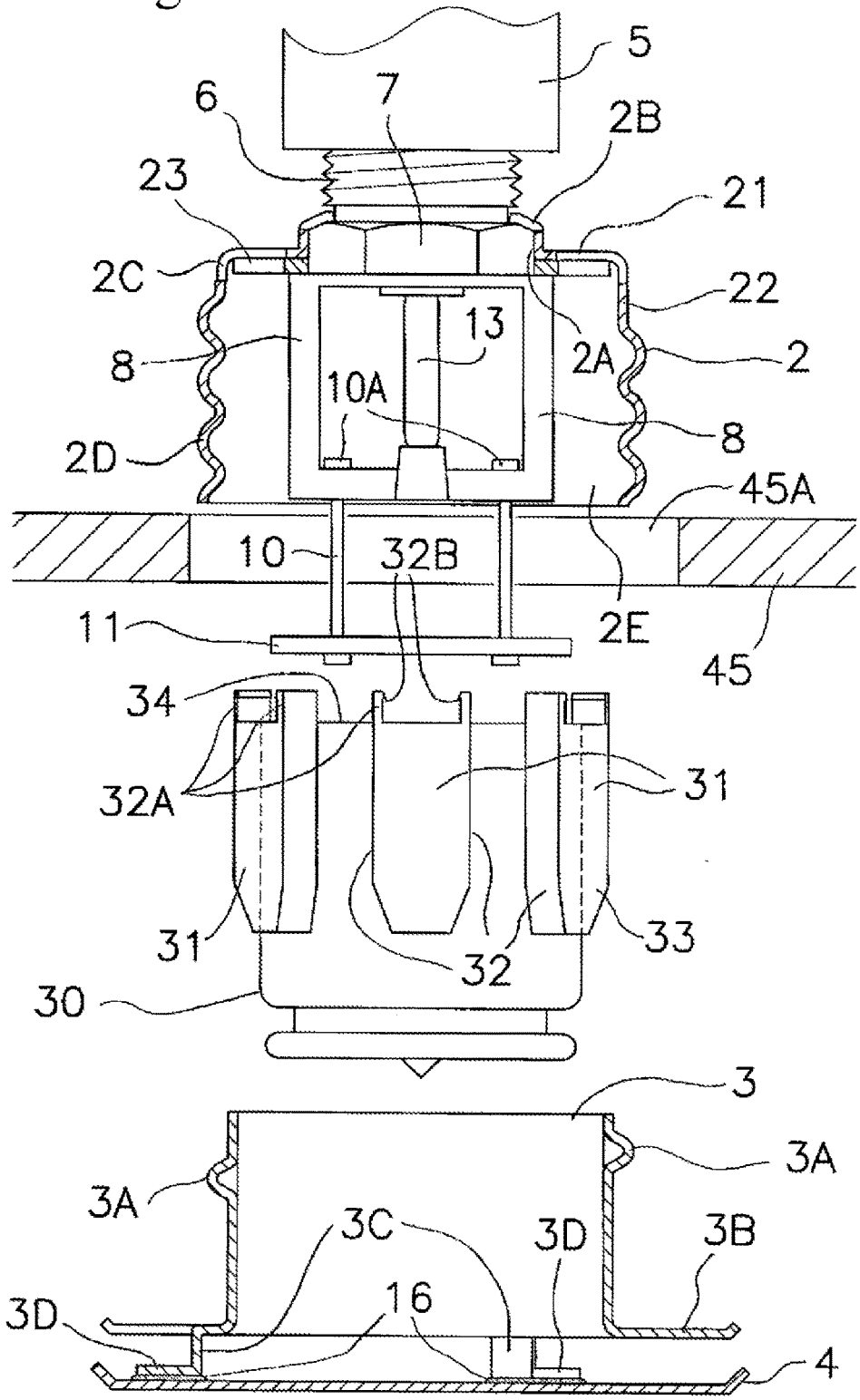
FIG. 2 is an exploded cross-sectional view of FIG. 1 (including a protecting cap).

First Embodiment (FIG. 1 to FIG. 6)

Referring now to FIG. 1 to FIG. 6, a first embodiment will be described. A sprinkler head SH according to the first embodiment includes a sprinkler head body 1, a cylindrical member 2, a retainer 3, and a cover plate 4.

The sprinkler head body 1 includes a male screw 6 to be connected to a water supply pipe 5 on the outer portion thereof, and a nozzle 6A indicated by a dotted line in the drawing is provided in the interior of the male screw 6. A hexagonal portion 7 is formed at a base of the male screw 6. Two arms 8 extend downward from the hexagonal portion 7, and the arms 8 are joined to an extension portion in the center of the nozzle 6A, so that a boss 9 is formed. The respective arms 8, 8 are formed respectively with holes 8A in the vicinity of the boss 9, and pins 10 are inserted into the holes 8A. Flange portions 10A are formed at the ends of the pins 10 on the side of the nozzle 6A, and the pins 10 can be engaged with ends of the holes 8A.

The other ends of the pins 10 engage a plate-shaped deflector 11. The pins 10 are slidable within the holes 8A, and the deflector 11 is also slidable in association with the sliding movement of the pins 10.

An exit of the nozzle 6A is closed by a valve 12, and a glass bulb 13 formed by injecting alcohol into a glass tube is installed between the valve 12 and the boss 9. The glass bulb 13 is pressed toward the valve 12 by an impress screw 14 screwed through the interior of the boss 9. The glass bulb 13 is configured in such a manner that when alcohol in the interior thereof is expanded and hence the glass tube explodes in case of a fire, the valve 12 is released and the nozzle is opened, so that water in the water supply pipe 5 is discharged.

The cylindrical member 2 has a cylindrical shape, and an upper end thereof is closed by a flat surface 21. The flat surface is fixedly installed between the hexagonal portion 7 and the arms 8 of the sprinkler head body 1. The flat surface 21 is formed with a hexagonal hole 2A which can be fitted to the hexagonal portion 7, and a extending portion 2B extending upright along the side surface of the hexagonal portion 7 is formed at a peripheral edge of the hexagonal hole 2A. The extending portion 2B is bent at a distal end of the extending portion 2B after having been mounted over the hexagonal portion 7 inward of the hexagonal hole 2A and the cylindrical member 2 on the sprinkler head body 1 is fixedly install.

Openings 2C are formed in the vicinity of the hexagonal hole 2A from the flat surface 21 to the side surface 22. The openings 2C are arranged at regular intervals along a peripheral edge of the flat surface 21, and the openings 2C are provided at six positions in this embodiment.

Figure 3:
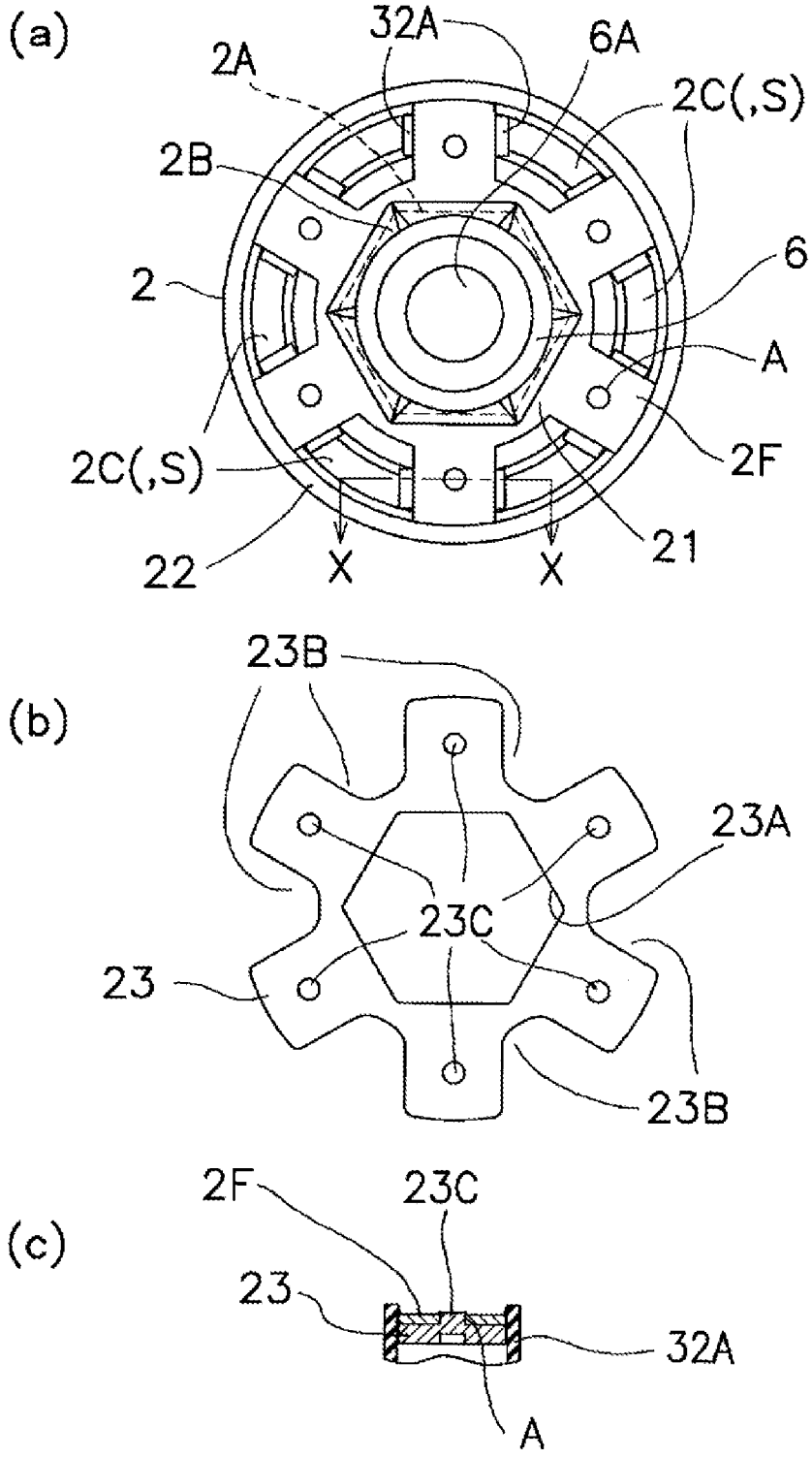
FIG. 3(*a*) is a plan view of FIG. 2, FIG. 3(*b*) is a plan view of the support base, and FIG. 3(*c*) is a cross-sectional view taken along the line X-X.

It is also possible to interpose a support base 23 when inserting the hexagonal portion 7 into the hexagonal hole 2A of the flat surface 21. The support base 23 has a plate shape as illustrated in FIG. 3(*b*) and is formed with a hole 23A having the same shape as the hexagonal hole 2A at the center thereof, and has notches 23B having the shape of the openings 2C along the peripheral edge thereof. The support base 23 is formed with projections 23C projecting from the flat surface 21 side, and the projections 23C engage holes A formed through beam portions 2F formed between adjacent openings 2C, so that the cylindrical member 2 and the support base 23 are capable of rotating together.

An excessive load is applied to the cylindrical member 2 via the intermediary of the support base 23 when the sprinkler head SH is mounted onto and demounted from the water supply pipe by using a tightening tool 40, described later, so that the openings 2C (the edge of the beam portions 2F) are prevented from being deformed and damaged. In addition, by reinforcing the tightening tool engaging portion with the support base 23, the cylindrical member 2 may be formed so as to be thin.

In order to obtain the same effect as described above, if the edges of the openings 2C are bent to provide edge portions extending upright or when the upright portions are bent toward the beam portions 2F between the openings 2C, the strength of the edge portion of the openings 2C is improved. Also, the beam portions 2F may be formed with reinforcing ribs for preventing deformation of the beam portions 2F when mounting and demounting the sprinkler head SH to the water supply pipe by the tightening tool 40.

On the side surface 22 of the cylindrical member 2 is formed with a helical groove 2D as connecting means for connection to the retainer 3. The helical groove 2D may be formed by using rolling process by making the cylindrical member 2 a thin member. The helical groove 2D is engaged with the projection 3A formed on the outer peripheral surface of the retainer 3 by being screwing together, so that the heightwise position of the retainer 3 can be adjusted. The lower portion of the cylindrical member 2 is an opening 2E.

The retainer 3 is configured to be connected with the cylindrical member 2 as described above. The retainer 3 has a cylindrical shape and is formed with a flange portion 3B at a lower end thereof. In addition, a plurality of legs 3C extend downward from the flange portion 3B.

Distal ends of the legs 3C are bent horizontally, and are formed with a connecting surface 3D to be connected to the cover plate 4. A low melting point alloy 16 is interposed between the connecting surface 3D and the cover plate 4, and the cover plate 4 and the connecting surface 3D are joined to each other by the low melting point alloy 16.

Since the low melting point alloy 16 is melted by heat in case of a fire to release the cover plate 4, at temperatures lower than the temperature at which the glass bulb 13 explodes is selected as the melting temperature of the low melting point alloy 16.

The cover plate 4 is a disk-shaped thin plate and the peripheral edge is bent toward the retainer 3. A surface of the cover plate 4 opposite from the surface connected to the retainer 3 (the surface viewed from the room interior side) is decorated in substantially the same color as ceiling board 45. As the material of the cover plate 4, copper or a copper alloy having a good joining property with respect to the low melting point alloy 16 is suitable. When a resilient member (not shown) is installed between the cover plate 4 and the flange portion 3B of the retainer 3, dropping of the cover plate 4 due to the melting of the low melting point alloy 16 in case of a fire is accelerated.

Figure 4:
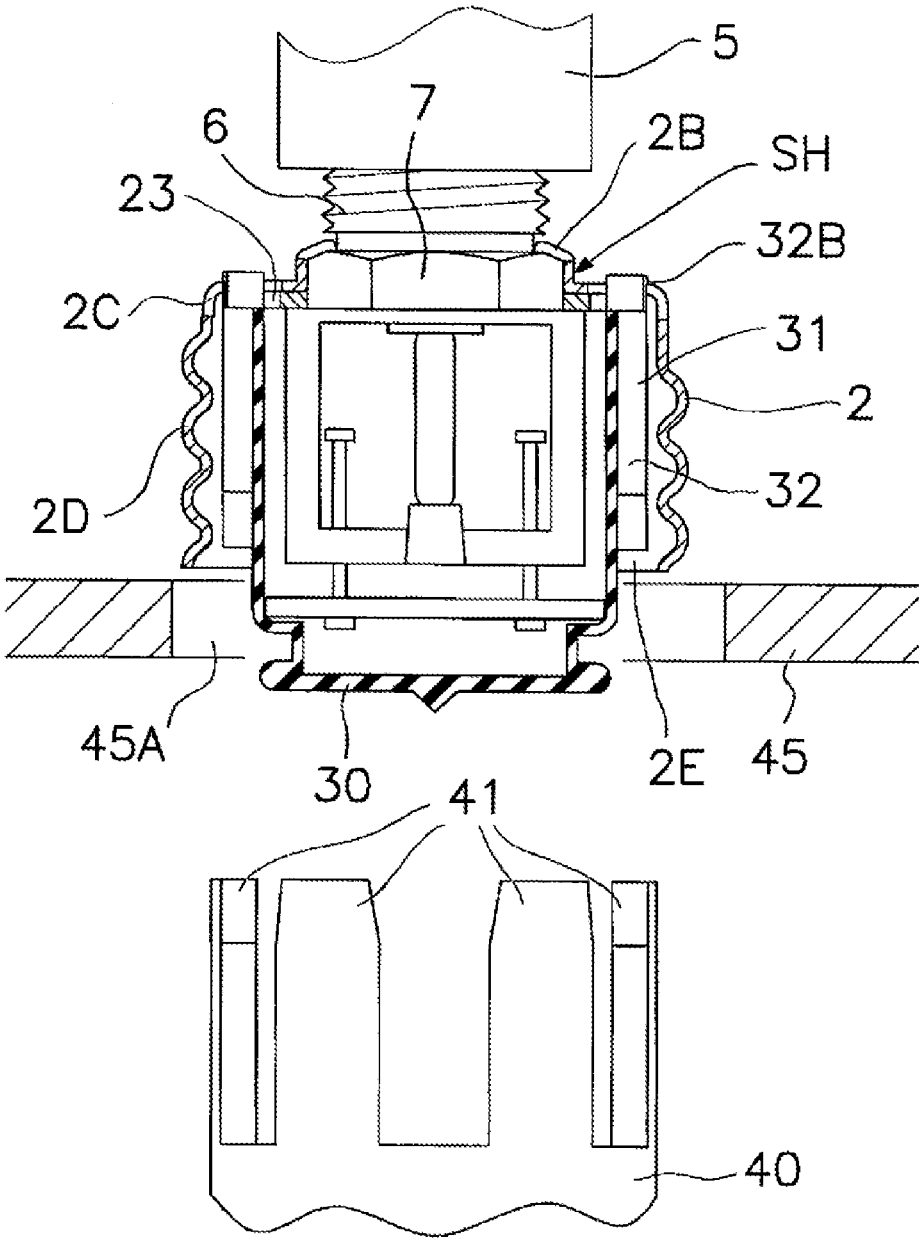
FIG. 4 is a cross-sectional view of a state in which the protecting cap is mounted on the sprinkler head.

FIG. 4 shows a cross-sectional view of a state in which a protecting cap 30 is mounted. The protecting cap 30 has a closed-bottomed cylindrical shape, and a plurality of projecting portions 31 extending in the direction of the outer circumference are formed on the side surface thereof. Distal ends of the projecting portions 31 are engaged with the above-described openings 2C, so that the place and position of installation correspond to the openings 2C. The projecting portions 31 are composed of two side surface portions 32 and an outer surface portion 33 between the side surface portions 32, 32.

Distal end portions 32A of the side surface portions 32 are formed so as to project from an opening 34 of the protecting cap 30, and are locked to the beam portions 2F between the openings 2C of the cylindrical member 2. The distal end portions 32A are formed with steps 32B which are capable of maintaining the engaging state with the beam portions 2F. Through the engagement of the protecting cap 30 with the beam portions 2F of the cylindrical member 2, spaces S which are capable of penetrating from the lower end opening 2E of the cylindrical member 2 to the openings 2C are formed in the flat surface 21 of an upper end thereof. The outer surface portion 33 of the protecting cap 30 is installed in the proximity to the inner peripheral surface of the cylindrical member 2.

Figure 5:
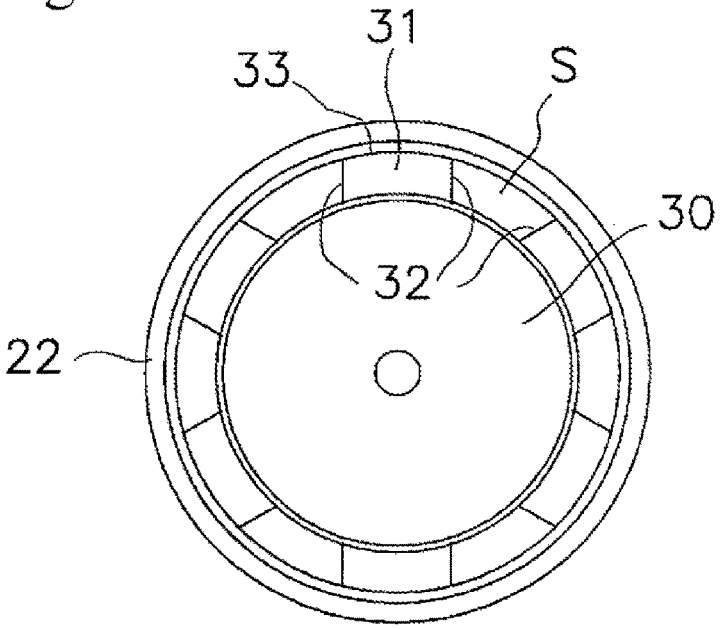
FIG. 5 is a bottom view viewed from the bottom surface side of the protecting cap in FIG. 4.

FIG. 5 illustrates a state of the sprinkler head in FIG. 4 viewed from the bottom surface side of the protecting cap 30. In FIG. 5, the spaces S which are capable of penetrating to the openings 2C of the cylindrical member 2 are provided between the projecting portions 31 of the protecting cap 30, so that the tightening tool 40 can be inserted into the spaces S. The tightening tool 40 inserted through the spaces S is engageable with the edges of the openings 2C (the edges of the beam portions 2F) via the side surface portions 32 of the protecting cap 30. Therefore, mounting onto the water supply pipe 5 by using the tightening tool 40 can be performed in a state in which the sprinkler head has the protecting cap 30 mounted thereon.

When causing an engaging portion 41 at the distal end of the tightening tool 40 to be inserted into the spaces S, the engaging portion 41 is guided to the opening 2C by the side surface portions 32, 32 of the projecting portions 31, and the side surface portions 32, 32 serve as a guide.

Even when an attempt is made to mount the retainer 3 on the cylindrical member 2 in a state in which the protecting cap 30 is mounted on the cylindrical member 2, the end of the cylindrical portion of the retainer 3 abuts the projecting portions 31 of the protecting cap 30 and hence the projection 3A of the retainer 3 cannot be screwed into the helical groove 2D of the cylindrical member 2. Therefore, when installing the retainer 3 on the cylindrical member 2, forgetting to remove the protecting cap 30 is prevented.

Subsequently, the procedure of installation of the sprinkler head described above will be described.

The sprinkler head is in a state in which the cylindrical member 2 has been installed on the outside of the sprinkler head body 1 and the protecting cap 30 is engaged with the cylindrical member 2 in a stage before being connected to the water supply pipe.

The tightening tool 40 is inserted into the cylindrical member 2 from the bottom side of the protecting cap 30, the engaging portion 41 at the distal end of the tightening tool 40 is engaged with the opening 2C to screw the male screw 6 of the sprinkler head body 1 into the female screw formed at a terminal of the water supply pipe 5 to connect the water supply pipe to the sprinkler head.

As the next step, the ceiling board 45 is installed. A hole 45A is formed in the ceiling board 45 where the sprinkler head is installed, and a distal end of the protecting cap 30 mounted on the sprinkler head body 1 projects from the ceiling surface after the installation of the ceiling board 45.

Subsequently, the protecting cap 30 is removed to allow the retainer 3 to be installed on the cylindrical member 2. At that time, even when an attempt is made to mount the retainer 3 in a state in which the protecting cap 30 is mounted on the cylindrical member 2, the projecting portions 31 of the protecting cap 30 abut the end of the cylindrical portion of the retainer 3 and hence the projection 3A cannot be screwed into the helical groove 2D of the cylindrical member 2. Therefore, forgetting to remove the protecting cap 30 is prevented.

The projection 3A formed on the side surface of the retainer 3 is screwed into the helical groove 2D of the cylindrical member 2 and the flange portion 3B connected to the lower portion of the retainer 3 is adjusted to come to the position where the flange portion 3B abuts the ceiling board 45. Accordingly, the installation of the sprinkler head is completed.

Subsequently, the operation of the sprinkler head will be described.

The sprinkler head body 1 is connected to the water supply pipe 5 in the ceiling filled with water, and is arranged so that only the cover plate 4 is visible from the ceiling surface as described above. In case of a fire, the low melting point alloy 16 connecting the cover plate 4 and the retainer 3 is melt by the heat of the fire.

When the low melting point alloy 16 melts, the joint strength is lowered, the cover plate 4 drops, and the sprinkler head body 1 installed in the ceiling is exposed. As a result of the demounting of the cover plate 4, hot air of the fire flows also into the cylindrical member 2, and the glass bulb 13 is heated.

When the glass bulb 13 is heated and the alcohol in the interior is expanded, the glass bulb 13 explodes and the valve 12 comes apart from the terminal end of the nozzle 6A, so that the nozzle 6A is released.

Figure 6:
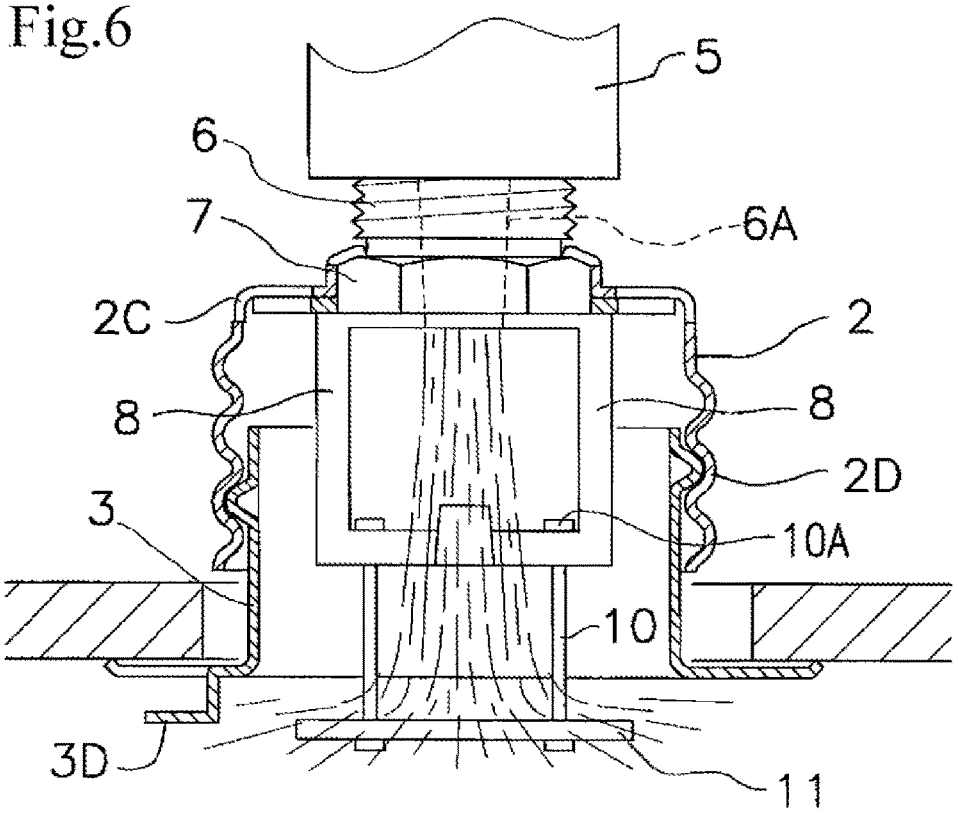
FIG. 6 is a cross-sectional view in which the sprinkler head according to the first embodiment is operated.

The water filled in the water supply pipe 5 is discharged from the nozzle 6A, and the water hitting the deflector 11 on the extension portion of the nozzle 6A flies in all directions in the room to prevent the fire from spreading, and extinguish the fire (see FIG. 6).

Figure 7:
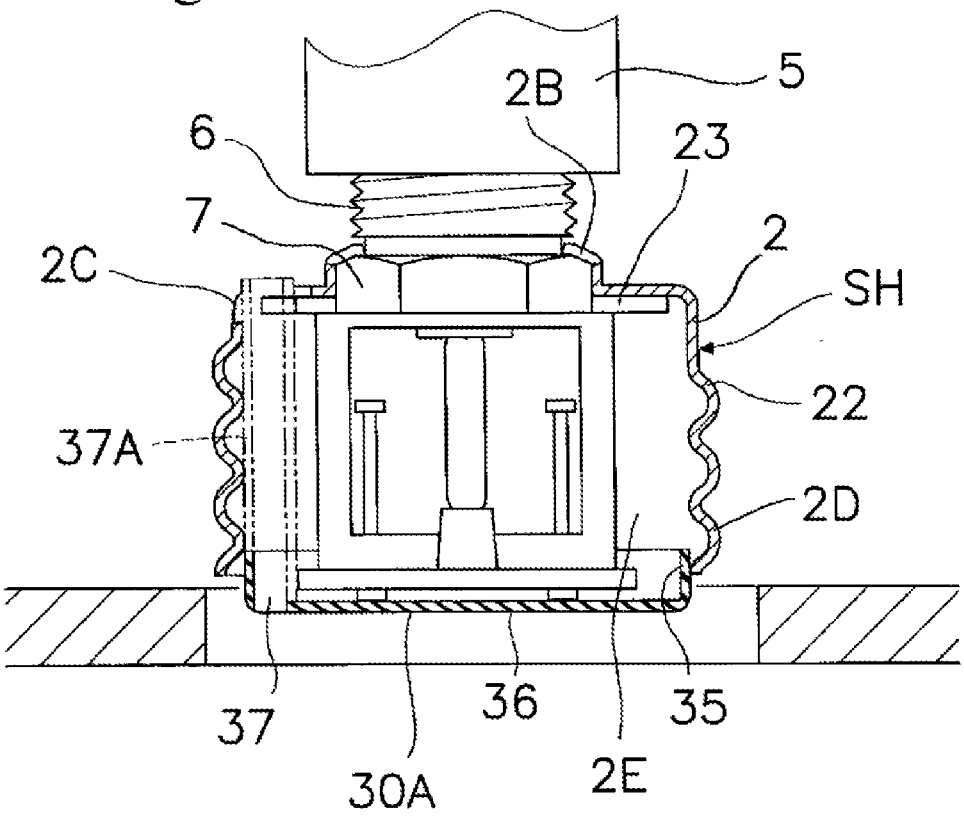
FIG. 7 is a cross-sectional view of a state in which the protecting cap is mounted on the sprinkler head according to a second embodiment.
Figure 8:
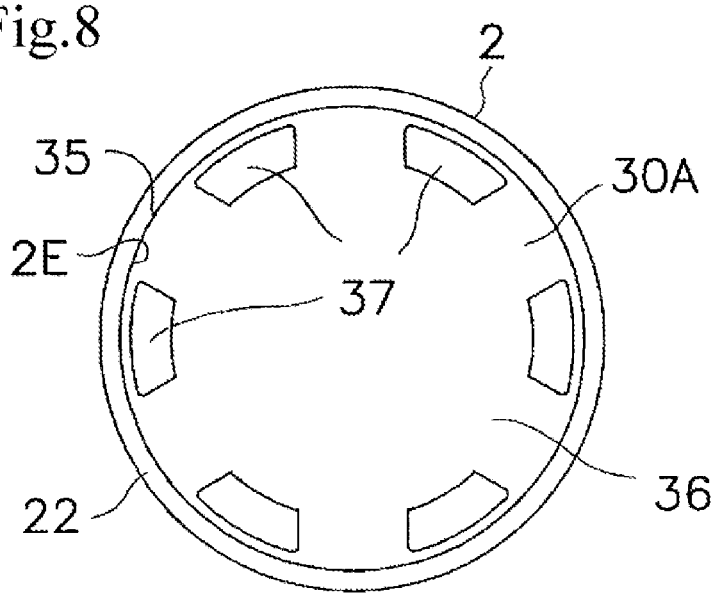
FIG. 8 is a bottom view of FIG. 7.

Second Embodiment (FIGS. 7, 8)

Subsequently, referring now to FIGS. 7 and 8, a second embodiment will be described. Parts having the same structure as those in the first embodiment are designated by the same reference numeral and the description will be omitted.

In the second embodiment, as illustrated in FIGS. 7 and 8, a protecting cap 30A has a lid shape, and a edge portion 35 of the protecting cap 30A is fitted to the opening 2E at the lower end of the cylindrical member 2. Holes 37 which allow penetration from a lower surface 36 of the protecting cap 30A to the openings 2C of the cylindrical member 2 are formed in the protecting cap 30A. The holes 37 corresponds to the position and the number of the openings 2C.

As illustrated by a double dashed chain line in FIG. 7, it is also possible to form cylindrical portions 37A extending from the holes 37 to the edge of the openings 2C. Distal ends of the cylindrical portions 37A may be locked to the edges of the openings 2C in the same manner as in the first embodiment. In this case, since the protecting cap 30A is locked by the openings 2C, it is not necessary to cause the edge of the protecting cap 30A to be locked by the opening 2E at the lower end of the cylindrical member 2.

The holes 37 and the cylindrical portions 37A have a role as a guide which guides the engaging portion 41 at the distal end of the tightening tool 40 into the openings 2C of the cylindrical member 2.

In FIG. 7 and FIG. 8, although the protecting cap 30A is formed into a lid shape formed of a thin plate, and may be formed into a thinner film shape. It is also possible to adhere the protecting cap 30A formed into a film shape to a lower end surface or the outer peripheral surface of the cylindrical member 2. By employing the film transparent or translucent which allows the interior to be seen through, the position of the openings 2C can be confirmed easily in a state in which the film is not broken.

The film-shaped protecting cap 30A may be broken by being stuck by an engaging portion 41 at the distal end of the tightening tool 40, so that the male screw 6 can be screwed into the female screw of the water supply pipe 5 by engaging the engaging portion 41 with the openings 2C and causing the tightening tool 40 and the sprinkler head to rotate together.

Figure 9:
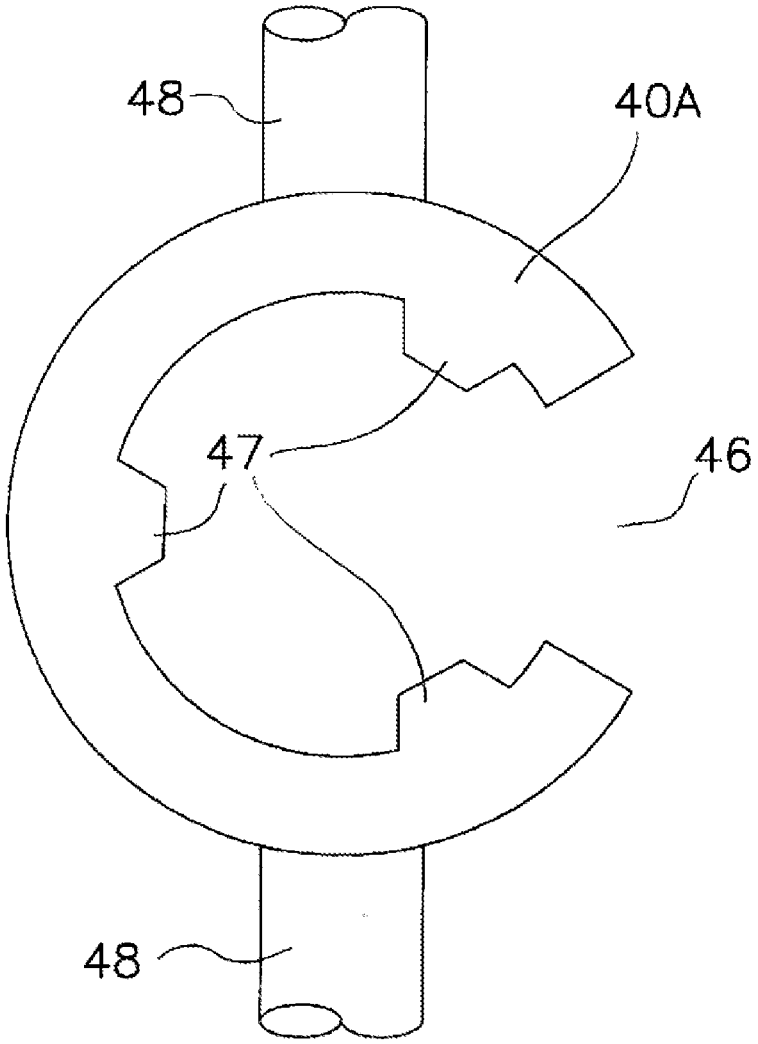
FIG. 9 is a plan view of a tightening tool according to a third embodiment.
Figure 10:
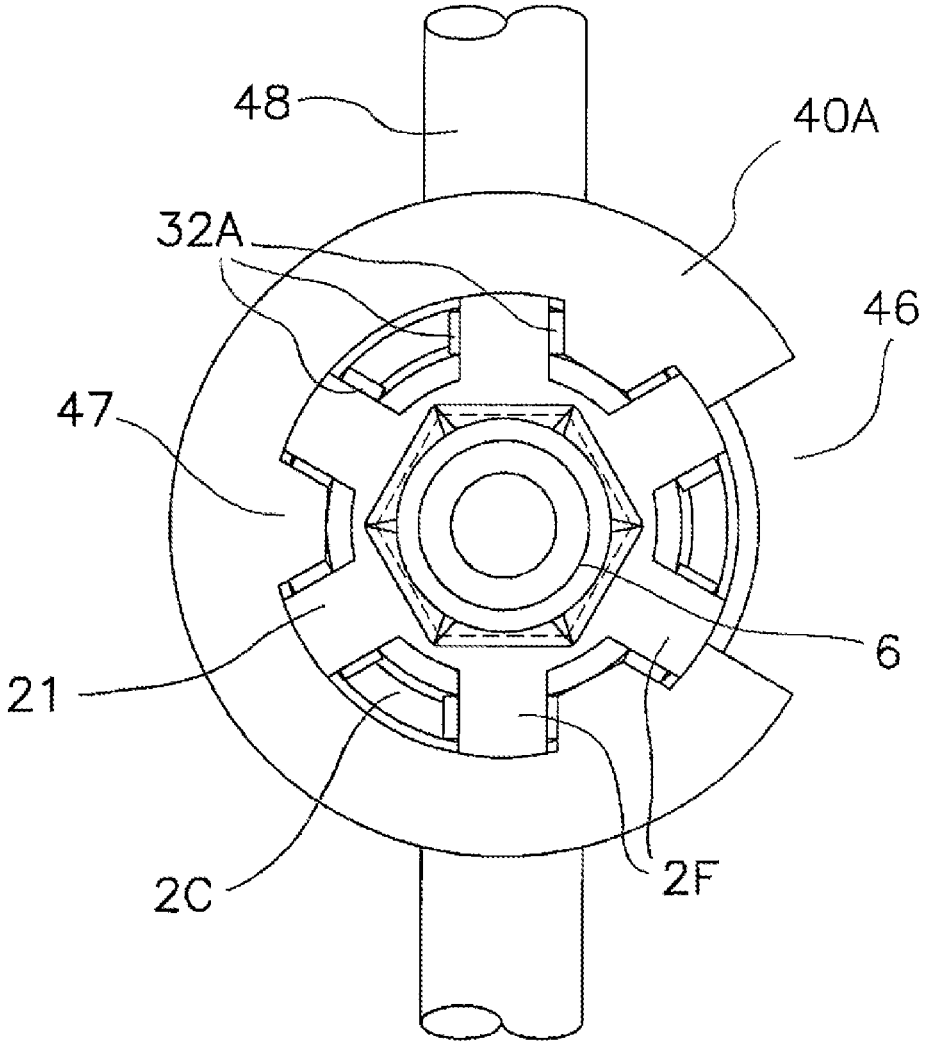
FIG. 10 is a plan view of a state in which the tightening tool in FIG. 9 is mounted on the sprinkler head.
Figure 11:
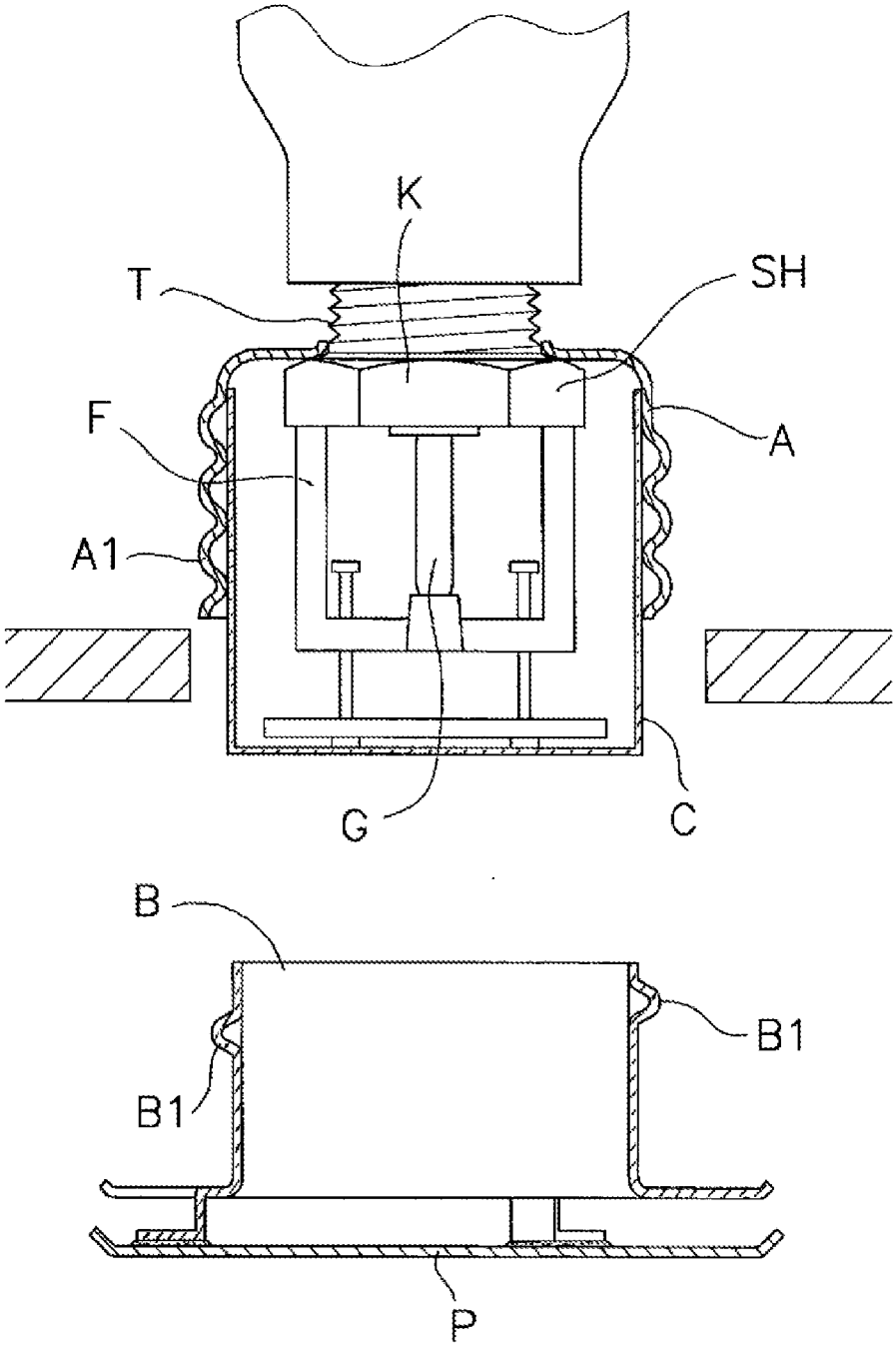
FIG. 11 illustrates a state in which the protecting cap is mounted in FIG. 12.
Figure 12:
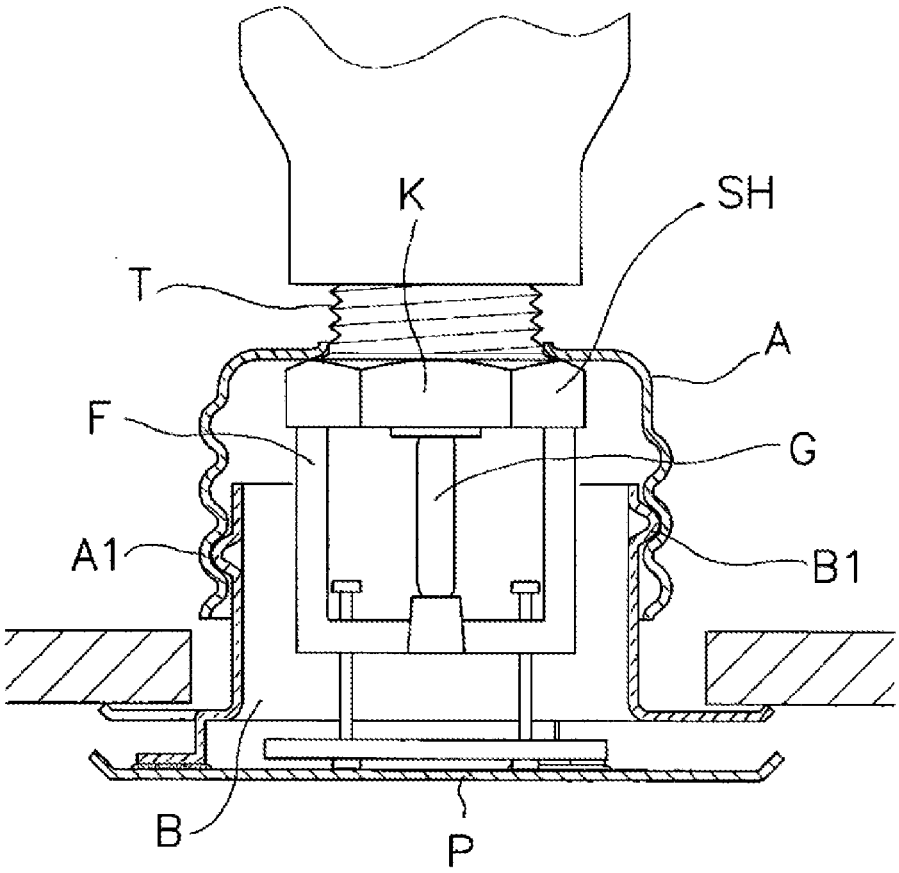
FIG. 12 is a cross-sectional view of the sprinkler head in the related art.

Third Embodiment (FIGS. 9, 10)

Referring further to FIGS. 9, 10, a third embodiment will be described. In the third embodiment as well, parts having the same structure as those in the first embodiment are designated by the same reference numeral and the description will be omitted.

In the third embodiment, the modes of the sprinkler head SH and the protecting cap 30 are the same as those in the first embodiment. Different points are that the tightening tool 40A is configured to be engageable with the openings 2C from the flat surface 21 side at the upper end of the cylindrical member 2.

The tightening tool 40A has a rink shape and is partly notched, and the width of a notched portion 46 is on the order of allowing the male screw 6 to pass through. The tightening tool 40A is formed with a plurality of projections 47 engageable with the openings 2C on the inner peripheral edge of the tightening tool 40A. In FIGS. 9 and 10, three of the projections 47 are formed and the positions of the projections correspond to the openings 2C. A handle 48 is installed on the outer peripheral portion of the tightening tool 40A.

When the male screw 6 of the sprinkler head body 1 is connected to the water supply pipe 5 by locking the tightening tool 40A with the openings 2C, the notched portion 46 is inserted into the male screw 6, and then the projections 47 is engaged with the openings 2C of the cylindrical member 2. In a state in which the projections 47 is engaged with the openings 2C, the handle 48 is rotated to cause the male screw 6 to be screwed in a female screw, not shown, at a terminal end of the water supply pipe 5.

After the male screw 6 is connected to the water supply pipe 5, the tightening tool 40A is moved toward the water supply pipe 5 to disengage the projections 47 and the openings 2C. The notched portion 46 is inserted into the male screw 6 and the tightening tool 40A is removed, so that the operation is terminated.

In the third embodiment, the operation can be performed without touching the protecting cap 30 when connecting the sprinkler head body 1 to the water supply pipe 5.

Figure 13:
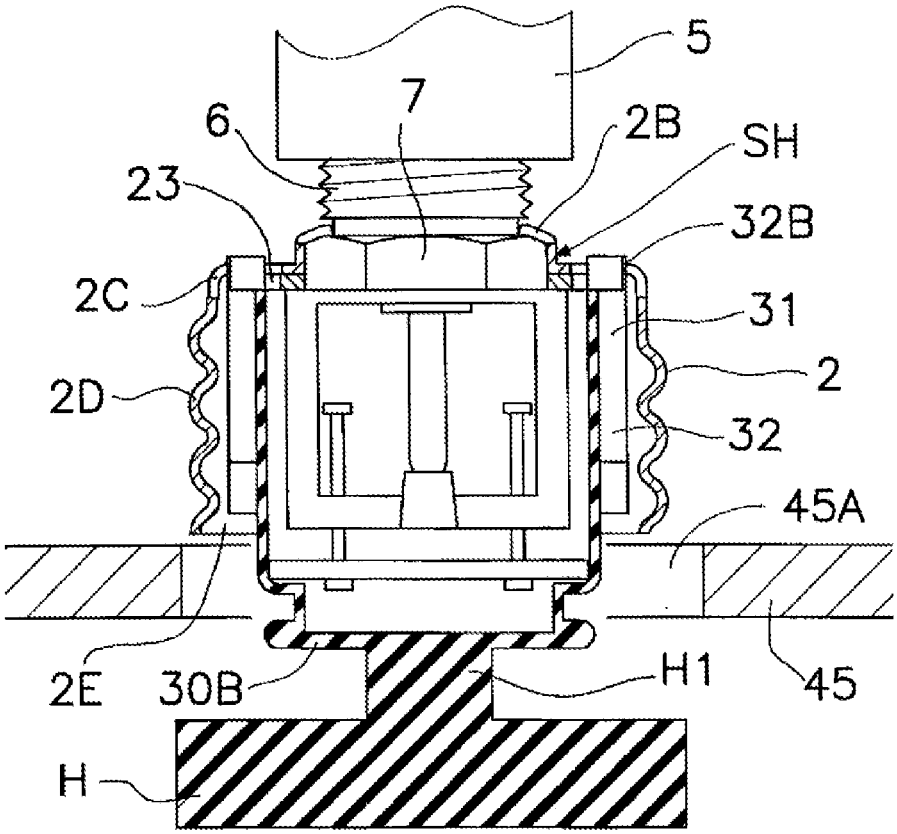
FIG. 13 is a cross-sectional view of a state in which the protecting cap is mounted on the sprinkler head according to a fourth embodiment.

Fourth Embodiment (FIG. 13)

Referring further to FIG. 13, a fourth embodiment will be described. In the fourth embodiment as well, parts having the same structure as those in the first embodiment are designated by the same reference numeral and the description will be omitted.

The different point of the fourth embodiment from the protecting cap 30 in the first embodiment is that a handle H is provided on a bottom surface, and the male screw 6 is configured to be capable of being screwed into the female screw of the water supply pipe 5 by rotating the handle H. A protecting cap 30B of the fourth embodiment includes the handle H formed so as to extend downward from the bottom surface of the protecting cap 30B as illustrated in FIG. 13, and the handle H and the protecting cap 30B are connected by a small diameter portion H1 of the protecting cap 30B having a smallest outer diameter. The small diameter portion H1 is a fragile portion which is broken when a predetermined or more torque is applied when being screwed into the water supply pipe 5, and is configured to prevent the breakage of the male screw 6 or the water supply pipe 5 due to the excessive tightening of the screw.

More specifically, when the male screw 6 is screwed into the female screw in a state in which the protecting cap 30B is mounted on the sprinkler head, the handle h is rotated to screw the male screw 6 into the female screw of the water supply pipe 5. When the male screw 6 is screwed into the female screw of the water supply pipe 5, if the male screw 6 is tightened toward the water supply pipe 5 more than necessary, an excessive load is applied, and the male screw 6 or the water supply pipe 5 may be broken and hence leakage may occur. However, when the male screw 6 or the water supply pipe 5 are rotated at a predetermined or more torque in the state before the male screw 6 or the water supply pipe 5 are broken, the small diameter portion H1 is broken and hence the sprinkler head cannot be rotated any longer, so that the breakage of the male screw 6 and the water supply pipe 5 due to the excessive tightening of the screw portion is prevented. The specific value of the torque that breaks the small diameter portion H1 is within a range from 40N·m to 60N·m.

Figure 14:
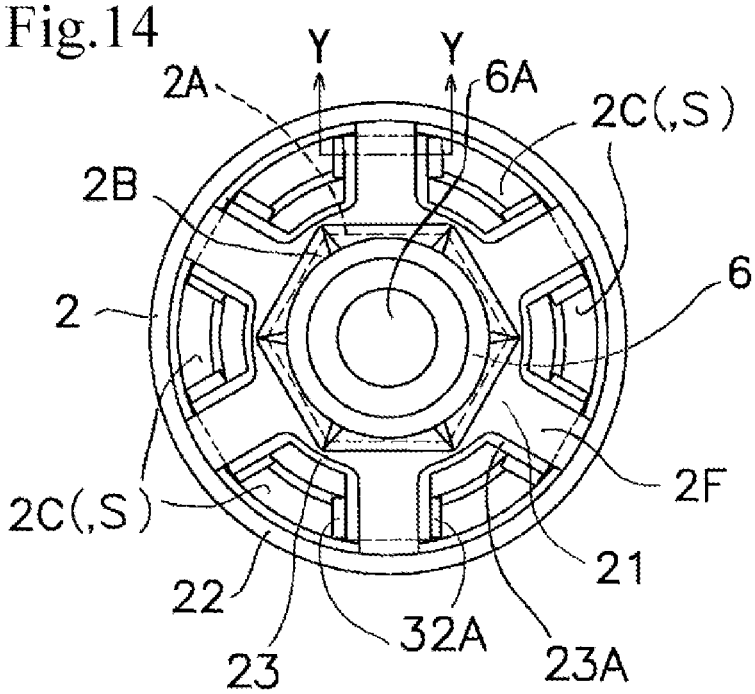
FIG. 14 is a plan view of a modification of the first embodiment.
Figure 15:
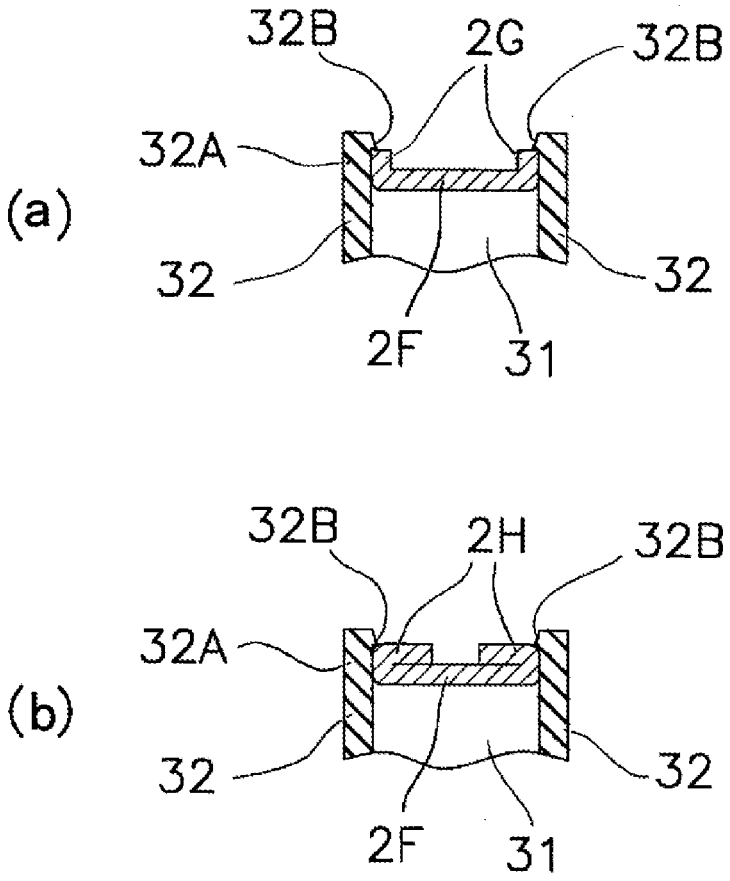
FIG. 15 is a modification of a cross-sectional shape taken along Y-Y in FIG. 14.

Modification of the First Embodiment (FIGS. 14, 15)

Referring to FIGS. 14 and 15, a modification of the First Embodiment (FIGS. 14, 15) will be described. Parts having the same structure as those in the first embodiment are designated by the same reference numeral and the description will be omitted.

In FIG. 14, edge portions 23A of the support base 23 is formed so as to protrude from the openings 2C, and the step 32B of the protecting cap 30 is locked by the edge portions 23A. By the engagement of the protecting cap 30 with the support base 23, the engaging portion 41 of the tightening tool 40 rotates in a state of pressing the side surface of the edge portions 23A of the support base 23 while coming into abutment with the side surface portions 32 of the protecting cap 30 when connecting the sprinkler head to the water supply pipe 5 by the tightening tool 40, so that the male screw 6 of the sprinkler head body 1 can be screwed into the female screw, not shown, of the water supply pipe 5.

At this time, since the thickness of the support base 23 is larger than the thickness of the beam portions 2F, the mechanical strength is high, and the force applied from the tightening tool 40 when connecting the sprinkler head to the water supply pipe 5 is received by the support base 23, so that the deformation and breakage of the beam portions 2F is prevented.

Furthermore, as a modification of FIG. 14, a configuration in which depressions having the shape of the beam portions 2F are formed on a surface of the support base 23 facing the beam portions 2F of the support base 23 and the beam portions 2F are fitted to the depression is also applicable.

In order to obtain the same effects as those described above, FIG. 15 illustrates a modification of a cross-sectional shape taken along Y-Y in FIG. 14. As an example of the openings 2C (the edges of the beam portions 2F) formed with reinforcing portions, as illustrated in FIG. 15(*a*), the mechanical strength of a portion where a force is applied from the engaging portion 41 may be improved by forming upright portions 2G by bending edges of the beam portions 2F. In addition as another modification, as illustrated in the same drawing (b), by forming a returning portions 2H formed by bending the edges of the beam portions 2F and folding distal ends toward the beam portions 2F, the mechanical strength of the portion to which the force is applied from the engaging portion 41 may be improved.

By forming the reinforcing portions on the openings 2C (the edges of the beam portions 2F) by the upright portions 2G and the returning portions 2H, the deformation or the breakage of the beam portions 2F by the force applied from the tightening tool 40 when connecting the sprinkler head to the water supply pipe 5 is prevented.

In the first to the fourth embodiment, the configuration in which the glass bulb is integrated in the sprinkler head body 1 has been described. However, the present invention is not limited thereto, and the sprinkler head having a mechanism described in Japanese Unexamined Patent Application Publication No. 7-284545 may be used.

REFERENCE SIGNS LIST

1 sprinkler head body
2 cylindrical member
2A hexagonal hole
2B extending portion
2C opening
2D helical groove
2E opening
2F beam portion
3 retainer
3A projection
3B flange portion
3C leg
3D connecting surface
4 cover plate
5 water supply pipe
6 male screw
7 hexagonal portion
8 arm
11 deflector
12 valve
13 glass bulb
14 impress screw
16 low melting point alloy
30 protecting cap
31 projecting portions
32 side surface portions
33 outer surface portion
34 opening
40 tightening tool
S space
SH sprinkler head

The invention claimed is:

1. A sprinkler head comprising:
a sprinkler head body;
a cylindrical member attached to a protecting cap, the sprinkler head body and the cylindrical member engaging each other so as to be rotatable together; and
a deflector located under the cylindrical member;
wherein the cylindrical member that is hollow includes:
a flat surface,
a side surface that forms a cylindrical wall entirely continued circumferentially and forms a space towards the deflector, and that extends from the flat surface toward the deflector,
the flat surface closes an upper end of the side surface, and
the flat surface is formed with a plurality of openings to form a tightening tool engaging portion;
wherein the space is formed directly underneath of each opening which allows a tightening tool for connecting the sprinkler head to a water supply pipe to be locked thereto, each opening is formed in the side surface continuously from the flat surface; and, wherein a plurality of holes which allow the tightening tool to be locked to the tightening tool engaging portion are formed in a lower surface of the protecting cap.

2. The sprinkler head according to claim 1, wherein a plurality of projecting portions extending in the direction of the outer circumference are provided on a side surface of the protecting cap, side surfaces of the adjacent projecting portions facing each other serve as guides to allow insertion of the tightening tool through spaces between the side surfaces of the facing projecting portions.

3. The sprinkler head according to claim 1, wherein each hole is provided at positions corresponding to each opening of the cylindrical member.

4. The sprinkler head according to claim 1, wherein the protecting cap is provided with a cylindrical portion extending from the holes to edges of the openings of the cylindrical member to allow the tightening tool to be guided to the tightening tool engaging portion.

5. The sprinkler head according to claim 1, wherein the protecting cap fits a lower end opening of the cylindrical member.

6. The sprinkler head according to claim 1, wherein the protecting cap is locked to the tightening tool engaging portion of the cylindrical member.

7. The sprinkler head according to claim 1, wherein beam portions configured to isolate the openings of the cylindrical member are formed with reinforcing portions formed by bending or folding edges of the beam portions, and the protecting cap is locked to the reinforcing portions.

8. The sprinkler head according to claim 1, further comprising a support base under the flat surface of the cylindrical member, and the support base is provided with notches which conform to the shape of the flat surface having the openings.

9. The sprinkler head according to claim 8, wherein the protecting cap engages the notches of the support base.

10. The sprinkler head according to claim 1, wherein the protecting cap is formed with a handle, and the handle includes a fragile portion which is broken when the handle is rotated at a predetermined or greater torque.

11. The sprinkler head according to claim 1, wherein the side surface extends perpendicularly from the flat surface downwardly.

12. A sprinkler head comprising:

a sprinkler head body;

a cylindrical member attached to a protecting cap, the sprinkler head body and the cylindrical member engaging each other so as to be rotatable together; and a deflector located under the cylindrical member, wherein the cylindrical member includes a flat surface, and a side surface that extends from the flat surface toward the deflector and forms a space, the flat surface closes an upper end of the side surface, and the flat surface is formed with a plurality of openings to form a tightening tool engaging portion;

wherein the space is formed directly underneath of each opening which allows a tightening tool for connecting the sprinkler head to a water supply pipe to be locked thereto;

each opening is formed in the side surface continuously from the flat surface; And wherein a plurality of holes which allow the tightening tool to be locked to the tightening tool engaging portion are formed in a lower surface of the protecting cap.

13. The sprinkler head according to claim 12, wherein a gap is between the side surface and an axis of the cylinder.

14. A sprinkler tool system comprising:

a sprinkler head according to claim 1, and a tightening tool having an engaging portion configured to connect to the sprinkler head and engageable with the opening of the cylinder member.

15. The tightening tool according to claim 14, wherein the tightening tool is between the side surface and an axis of the cylinder.

16. The tightening tool according to claim 14, wherein the tightening tool is inserted along an inside of the side surface and parallel to the side surface.

17. A sprinkler tool system comprising:

a sprinkler head according to claim 12, and a tightening tool having an engaging portion configured to connect to the sprinkler head and engageable with the opening of the cylinder member.

18. The tightening tool according to claim 17, wherein the tightening tool is inserted along an inside of the side surface and parallel to the side surface.

* * * * *